US008365649B1

(12) United States Patent
Andrews

(10) Patent No.: US 8,365,649 B1
(45) Date of Patent: Feb. 5, 2013

(54) MULTI-LAYERED COMPOSITE BELLY PLATE AND METHOD OF MAKING AND USING

(76) Inventor: Mark D. Andrews, Petoskey, MI (US)

( * ) Notice: Subject to any disclaimer, the term of this patent is extended or adjusted under 35 U.S.C. 154(b) by 982 days.

(21) Appl. No.: 12/371,041

(22) Filed: Feb. 13, 2009

Related U.S. Application Data

(60) Provisional application No. 61/068,885, filed on Feb. 13, 2008.

(51) Int. Cl.
*F41H 5/04* (2006.01)
*F41H 5/14* (2006.01)
*F41H 7/02* (2006.01)

(52) U.S. Cl. ..... 89/36.08; 89/36.07; 89/36.02; 89/912; 89/929; 428/911

(58) Field of Classification Search ..... 89/36.02, 89/36.07, 36.08, 36.09; 428/911
See application file for complete search history.

(56) References Cited

U.S. PATENT DOCUMENTS 2,068,785 A 1/1937 Bain et al.
2,723,214 A * 11/1955 Meyer ..... 428/49
4,061,815 A * 12/1977 Poole, Jr. ..... 428/215
4,316,286 A * 2/1982 Klein ..... 2/2.5
H1061 H * 6/1992 Rozner et al. ..... 89/36.02
5,352,304 A 10/1994 DeArdo et al.
5,976,656 A * 11/1999 Giraud ..... 428/44
6,465,047 B1 10/2002 Scott et al.
7,228,927 B2 * 6/2007 Hass et al. ..... 180/65.25
7,238,730 B2 7/2007 Apichatachutapan et al.
7,861,637 B2 * 1/2011 Leivesley ..... 89/36.02
8,096,223 B1 * 1/2012 Andrews ..... 89/36.02
2007/0234896 A1 * 10/2007 Joynt ..... 89/36.09
2008/0282876 A1 * 11/2008 Leivesley et al. ..... 89/36.02

* cited by examiner

*Primary Examiner* — Bret Hayes
(74) *Attorney, Agent, or Firm* — Jonathan M. Rixen; Charles A. Lemaire; Lemaire Patent Law Firm, P.L.L.C.

(57) ABSTRACT

A multi-layer armor structure that includes a first composite layer and a second composite layer affixed to the first composite layer, wherein the second composite layer includes a metal plate and sound-wave-deadening material. The first and second composite layers form an overall composite layer. Some embodiments provide a multi-layer composite-armor article that includes a first metal layer, wherein the metal layer has an outer face that will be closer to an outermost surface of the armor article, and an inner face that will be farther from the outermost surface of the armor article; and a multi-layer polymer structure attached to the inner face of the first metal layer, wherein the polymer structure has an outer portion that is attached to the inner face of the first metal layer, and an inner portion that has a lower durometer value than the outer portion.

22 Claims, 6 Drawing Sheets

MULTI-LAYERED COMPOSITE BELLY PLATE AND METHOD OF MAKING AND USING

CROSS-REFERENCE TO RELATED APPLICATIONS

This application claims benefit under 35 U.S.C. §119(e) of U.S. Provisional Patent Application 61/068,885 filed on Feb. 13, 2008, titled "MULTI-LAYERED COMPOSITE BELLY PLATE AND METHOD OF MAKING AND USING," which is incorporated herein by reference in its entirety.

This application is related to U.S. Provisional Patent Application 61/018,840 filed on Jan. 3, 2008, titled "PASSIVE ARMOR APPARATUS AND METHOD," U.S. Provisional Patent Application 61/068,886 filed on Feb. 13, 2008, titled "MULTI-LAYERED COMPOSITE STRUCTURE AND METHOD OF MAKING AND USING," U.S. Provisional Patent Application 61/119,023 filed on Dec. 1, 2008, titled "MULTI-LAYER COMPOSITE ARMOR AND METHOD," and U.S. patent application Ser. No. 12/347,937 filed on Dec. 31, 2008, titled "MULTI-LAYER COMPOSITE ARMOR AND METHOD," (which issued as U.S. Pat. No. 8,096,223 on Jan. 17, 2012) each of which is incorporated herein by reference in its entirety.

FIELD OF THE INVENTION

The present invention provides a multi-layered composite structure and method of making and using, and in particular, various embodiments described herein relate to using the structure as passive armor for, e.g., land vehicles, ships and buildings.

BACKGROUND OF THE INVENTION

In combat vehicles, armor is generally placed on the vehicle to protect the occupants from injury or to lessen the type and severity of injuries received when an enemy hits the combat vehicle with a projectile.

In addition, combatants are constantly working to improve projectile apparatus and methods of deployment. In some instances, the projectiles are improved to increase their ability to pierce armor of various types. Similarly, other combatants seek to improve armor to defeat the latest in projectile technology. Therefore, combatants are constantly seeking to improve armor to protect the troops that operate combat vehicles.

There is a need for improved armor for vehicles and buildings.

SUMMARY OF THE INVENTION

In some embodiments, the present invention provides a method for making a multi-layer composite-armor article that includes providing a first metal layer, the metal layer having an outer face that will be closer to an outermost surface of the armor article, and an inner face that will be farther from the outermost surface of the armor article and thus closer to the volume being protected (e.g., the passenger compartment); and attaching a multi-layer polymer structure to the inner face of the first metal layer, the polymer structure having an inner portion that is farther from the inner face of the metal layer than an outer portion of the polymer structure that is attached to the inner face of the first metal layer, wherein the inner portion has a lower durometer value than the outer portion. In some embodiments, the method further includes adding fiber reinforcement in at least one layer of the armor article.

In some embodiments, the present invention provides a multi-layer composite-armor article that includes a first metal layer, wherein the metal layer has an outer face that will be closer to an outermost surface of the armor article, and an inner face that will be farther from the outermost surface of the armor article; and a multi-layer polymer structure attached to the inner face of the first metal layer, wherein the polymer structure has an inner portion that is farther from the inner face of the metal layer than an outer portion of the polymer structure that is attached to the inner face of the first metal layer, and wherein the inner portion has a lower durometer value than the outer portion. In some embodiments, the apparatus includes fiber reinforcement located in at least one layer of the armor article.

BRIEF DESCRIPTION OF THE DRAWINGS

The invention is pointed out with particularity in the appended claims. However, a more complete understanding of the present invention may be derived by referring to the detailed description when considered in connection with the figures, wherein like reference numbers refer to similar items throughout the figures and:

Figure 1A:
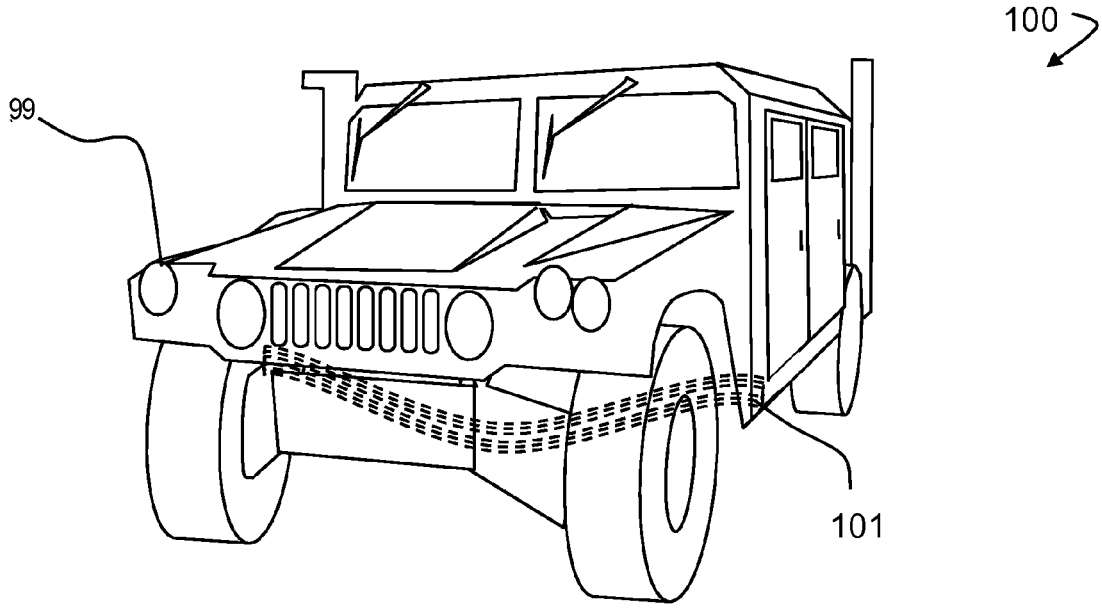
FIG. 1A is a perspective view of a multi-layer composite belly-plate system 100, according to an example embodiment.

The description set out herein illustrates the various embodiments of the invention and such description is not intended to be construed as limiting in any manner.

DETAILED DESCRIPTION

Although the following detailed description contains many specifics for the purpose of illustration, a person of ordinary skill in the art will appreciate that many variations and alterations to the following details are within the scope of the invention. Accordingly, the following preferred embodiments of the invention are set forth without any loss of generality to, and without imposing limitations upon the claimed invention.

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component that appears in multiple figures. Signals and connections may be referred to by the same reference number or label, and the actual meaning will be clear from its use in the context of the description.

As used herein a "projectile" is defined as an explosively-generated penetrating device or material (such as shrapnel), which is typically used to attack a vehicle or combatant. For example, improvised explosive devices (IEDs) are weapons that are constructed and deployed in ways other than in conventional military action, and that, when activated, generate both blast waves and projectiles (typically shrapnel). IEDs are often placed on roads so as to be detonated when vehicles or pedestrians pass by, and therefore are commonly associated with attacks that are directed to the bottom side of a vehicle. A projectile includes any penetrating object as the result of an IED, which will either be a shaped-charge warhead such as an EFP, or in the case of most other IEDs, shrapnel. In the latter case, shrapnel is either produced by the casing of the IED (i.e., artillery shell), or embedded material within the IED to produce shrapnel. Also, perhaps the most powerful result of an IED explosion is the actual blast itself. This is basically what a typical anti-tank mine is. It will breach the hull of a tank with the sheer force of an explosive blast alone (substantially no fragments or shrapnel). As used herein, a "ballistic projectile" is defined as an object that is fired (as from a gun or cannon) and that travels thereafter unpowered through the air as a weapon against a vehicle or person. In contrast, a missile is typically powered (e.g., by rocket or jet exhaust) for at least a portion of its flight. For example, an explosively-formed-penetrator (EFP) is a type of ballistic projectile used to penetrate armor effectively at stand-off distances.

As used herein, a "composite layer" is defined as a layer that comprises at least two different materials, or of one material processed to have different properties (such as polyurethane having similar formulas but processed to have different durometer (hardness) or density values). For example, a layer comprising polyurethane and fiber-reinforced steel is considered to be a composite layer.

As used herein, a "polymer" is defined as a large molecule (macromolecule) composed of repeating structural units connected by covalent chemical bonds. As used herein, "polyurethane" (also sometimes called "urethane") is defined as a class of polymers formed by reacting a monomer containing at least two isocyanate functional groups with another monomer containing at least two alcohol groups in the presence of a catalyst. Polyurethane formulations cover an extremely wide range of stiffness, hardness, and densities including low density flexible foam used in upholstery and bedding, low density rigid foam used for thermal insulation and e.g. automobile dashboards, soft solid elastomers used for gel pads and print rollers, and hard solid plastics used as electronic instrument bezels and structural parts.

As used herein, "durometer" (or "Shore durometer", as it is also known) is defined as a measure of the indentation resistance of elastomeric or soft plastic materials based on the depth of penetration of a conical indentor. Hardness values range from 0 (for full penetration by the conical indentor) to 100 (for no penetration). Full penetration is considered to be a penetration by the conical indentor of between approximately 2.46 and 2.54 mm (0.097 and 0.100 inches), depending on the equipment used. There are two primary durometer scales: durometer A and durometer D. "Durometer A" is the durometer scale used for softer materials. The conical indentor for a durometer-A measuring device has a 0.79-mm-diameter indentor and a 35-degree conical shape. "Durometer D" is the durometer scale used for harder materials. The conical indentor for a durometer-D measuring device has a 0.1-mm-diameter indentor and a 30-degree conical shape.

As used herein, a "bonding material" (also called "bonding agent") is defined as a compound or material that binds two or more items together (e.g., tar, concrete, casein glue, synthetic glue, plasters, putty, adhesives, ceramics, pastes, cellulosic fibers (e.g., paper), glass, clay, magnetized materials, resins, polymers such as polyurethane, etc.). A layer of such bonding material may, in some embodiments, form a structural element disposed between two layers that it is bonding to one another. For example, a layer of high-durometer polyurethane may be applied in liquid form between two previously formed layers (e.g., one of steel and another of lower-durometer polyurethane) and then cured (solidified) such that it holds or adheres to the steel and lower-durometer polyurethane.

As used herein, a "polymer structure" is defined as a structure at least part of which includes a polymer (but is not necessarily entirely made of one or more polymers). As used herein, a "multi-layer polymer structure" is defined as a polymer structure having at least two different materials or having one material with at least two different material properties (such as different durometer values or a gradient of continuously varying durometer values), and at least part of which includes a polymer. In some embodiments, a "multi-layer polymer structure" also includes one or more sublayers that include materials such as steel, compressed basalt fibers, and embedded reinforcement within polymers such as glass, carbon fiber, and ceramic. As used herein, a "ceramic" is defined as an inorganic, nonmetallic, solid material. Ceramics can be crystalline or noncrystalline, and noncrystalline ceramics include glass and a few other materials with amorphous structures. Ceramics can possess a covalent network structure, ionic bonding, or some combination of the two. Ceramics include structural ceramics (e.g., bricks, pipes, floor and roof tiles), refractories (e.g., kiln linings, gas fire radiants, steel and glass making crucibles), whitewares (e.g., tableware, wall tiles, decorative art objects and sanitary ware), and technical ceramics (e.g., alumina, zirconia, carbides, borides, nitrides, silicides, and particulate reinforced combinations of oxides and non-oxides).

As used herein, the "strike-face side" or "strike face" of an armor configuration is defined as the side of the armor in which a projectile or blast wave first comes into contact. For example, an explosively-formed-projectile (EFP) shot at an armor-protected vehicle from a position external to the vehicle will make first contact with the armor on the strike-face side of the armor. Similarly, the "vehicle side" of an armor configuration is herein defined as the side of the armor closest to the hull or protected volume of the vehicle being protected.

FIG. 1A is a perspective view of a multi-layer composite belly-plate system 100, according to an example embodiment. As shown in FIG. 1A, in some embodiments, the bottom side of the crew compartment of combat vehicle 99 is covered with armor 101, to protect from improvised explosive devices (IEDs) that are often directed toward a vehicle from the bottom (e.g., the bottom of armor 101 serves as the strike-face side of the armor). The armor 101 is provided so that passengers or troops within vehicle 99 are protected from explosions which may occur near the combat vehicle 100 or for certain projectiles (e.g., such as from explosively formed projectile devices or "EFPs") that may strike or be directed at vehicle 99 from the bottom. Armor 101 is formed such that the upward deformation of the passenger compartment caused by the projectile or blast wave is minimized and such that the acceleration of the projectile/blast wave is reduced. In some embodiments, additional armor sections 101 are provided on the back, front, sides, and/or top of vehicle 99 to protect from projectiles aimed at those aspects of vehicle 99. In some embodiments, vehicle 99 is a HMVVW (humvee)-type vehicle as shown. In other embodiments, vehicle 99 is a tank, ship, aircraft, limousine, or like vehicle.

Figure 1B:
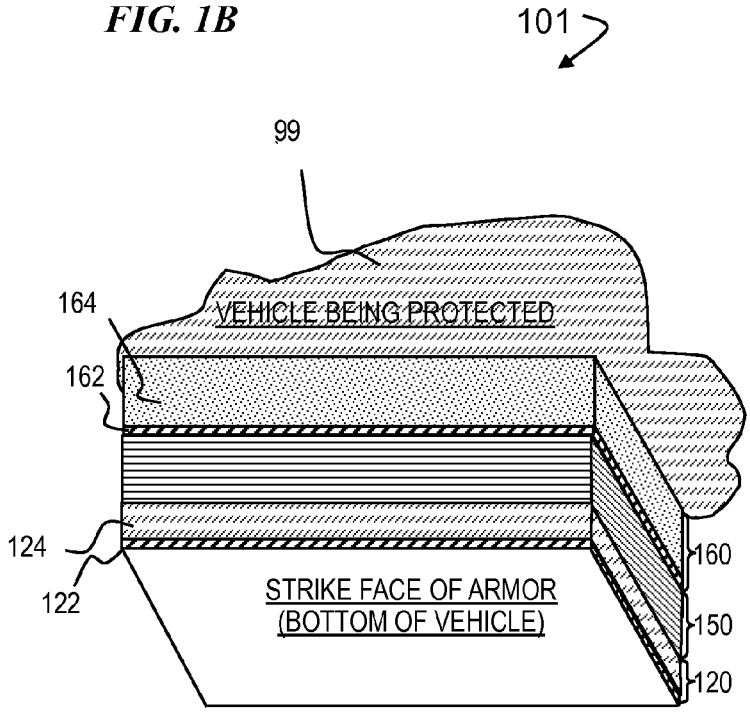
FIG. 1B is a perspective cross-section view of a multi-layered composite armor assembly 101, according to an example embodiment.

FIG. 1B is a perspective cross-section schematic view of a multi-layered composite armor (MLCA) assembly 101, according to an example embodiment. In some embodiments, MLCA assembly 101 includes a first armor layer 120, a second armor layer 150, and a third armor layer 160. In some embodiments, first layer 120 includes a metal strike face 122, embedded in or on a polymer material 124. In some embodiments, metal strike face 122 includes an approximately 3.175-mm-thick (⅛-inch-thick) bainite steel plate. In some embodiments, steel plate 122 includes a steel such as described in U.S. Pat. No. 5,352,304 titled "High strength low alloy steel" which issued Oct. 4, 1994 to DeArdo et al., and which is incorporated herein by reference. In some embodiments, metal strike face 122 includes an approximately 4.76-mm-thick (3/16-inch-thick) ballistic steel plate (e.g., MIL-A-46100 armor such as available from Temtco Steel, Armor Division, 2465 West Houston Avenue, Apache Junction, Ariz. 85220, www.omegaarmor.com/products.htm). In some embodiments, metal strike face 122 includes an approximately 3.175-mm-thick (⅛-inch-thick) stainless steel plate. In some embodiments, polymer material 124 is an approximately 12.7-mm-thick (½-inch-thick) polyurethane (e.g., a 93A-durometer polyurethane). In some embodiments, polymer material 124 is reinforced with embedded fibers and/or fabric (e.g., made of one or more materials such as basalt fibers, glass fibers, steel fibers, aramid (e.g., Kevlar®) fibers, ceramic chips. In some embodiments, the fibers in layer 124 are woven into a loose-weave (e.g., in some embodiments, with warf and woof fibers spaced on 1 mm centers to form fabric with square openings of less that 1 mm) fabric that allows the polymer to flow through more easily, and many layers of the fabric are used to cover the holes of other layers. In some embodiments, polymer material 124 is formed as described in FIG. 3 (in other embodiments, the vacuum apparatus is omitted and the polymer is poured onto metal strike face 122 in a normal atmosphere).

In some embodiments, the outer layer 120 includes hardened-metal layer 122 (e.g., steel, and in some embodiments, bainite steel) and a much softer but resilient and fiber-reinforced layer 124 (in some embodiments, for example, deadened non-rebounding polyurethane (e.g., viscoelastic polyurethane such as provided by U.S. Pat. No. 7,238,730, titled "VISCOELASTIC POLYURETHANE FOAM", issued Jul. 3, 2007, which is incorporated herein by reference) reinforced with one or more materials such as basalt fibers, glass fibers, steel fibers, aramid (e.g., Kevlar®) fibers, and ceramic chips). In some embodiments, one or more of the viscoelastic materials described in U.S. Pat. No. 7,238,730 is used, but without being foamed. In some embodiments, the one or more of the viscoelastic materials described in U.S. Pat. No. 7,238,730 is substantially free of flame retardant and passes California Technical Bulletin 117-Flammability test as a result of its isocyanate component and its isocyanate-reactive blend. In some embodiments, one or more of the polymer structures described herein includes a flame retardant. In some embodiments, the armor of the present invention further includes one or more elements, layers, composite structures, and/or methods as are described in the inventor's copending U.S. patent application Ser. No. 12/347,937 filed on Dec. 31, 2008, titled "MULTI-LAYER COMPOSITE ARMOR AND METHOD", (which issued as U.S. Pat. No. 8,096,223 on Jan. 17, 2012), which is incorporated herein by reference.

In some embodiments, the second armor layer 150 includes basalt fibers, glass fibers, steel fibers, aramid fibers, and/or ceramic or fabric chips pressed into a dense mat with minimal binders (such as epoxy resins). This hard fiber or fiber-reinforced layer is better able to stop the remaining parts of the projectile because of the transfer of momentum to large mass over a large area traveling at a much smaller velocity than the original projectile, and due to the tensile strength of the material(s). In some embodiments, second armor layer 150 includes an approximately 25.4-mm-thick (1-inch-thick) layer of basalt fiber cross-laid straight-fiber mat).

In some embodiments, the third armor layer 160 includes a metal layer 162 (e.g., steel, and in some embodiments, bainite steel) and a much softer but resilient (and, in some embodiments, fiber-reinforced) layer 164 (e.g., deadened non-rebounding polyurethane). In some embodiments, metal layer 162 includes an approximately 3.175-mm-thick (⅛-inch-thick) bainite steel plate. In some embodiments, third armor layer 160 is formed as described in FIG. 3 (in other embodiments, the vacuum apparatus is omitted and the polymer is poured onto the fiber mat in a normal atmosphere). Because much of the remaining projectile pieces are likely to strike the metal layer 162 at a shallower angle, they are more likely to be deflected or stopped rather than passing through. The sound-deadening properties of the inner-most deadened non-rebounding polyurethane layer 164 help reduce the sound blast to the protected compartment, thus reducing brain and ear damage of the occupants. In some embodiments, layer 164 includes a fiber-reinforced, approximately 12.7-mm-thick (½-inch-thick) polyurethane (e.g., a deadened non-rebounding polyurethane). In some embodiments, harder materials are used on the strike-face side of assembly 101 such that projectiles striking the underside of vehicle 99 are met with stiff resistance, while softer materials are used on the vehicle side of assembly 101 in order to better absorb the blast/sound wave caused by the projectile striking the underside of vehicle 99 and therefore better protect the passenger compartment of vehicle 99. For example, in some embodiments, layer 164 includes polyurethane having a lower durometer value than the durometer value of polymer material 124 (e.g., in some embodiments, polymer material 124 includes a 93A-durometer polyurethane and layer 164 includes an 83A-durometer polyurethane).

In some embodiments, one or more of the metal-plate layers (e.g., 122 or 162) include steel that is reinforced and/or strengthened using a bainite or other suitable process of hardening. (Bainite is a mostly metallic substance that exists in steel after certain heat treatments. First described by E. S. Davenport and Edgar Bain (see, e.g., U.S. Pat. No. 2,068,785 to Bain et al, issued Jan. 26, 1937, which is incorporated herein by reference, and E. S. Davenport and E. C. Bain. Trans Met Soc AIME 90 (1930), p. 117), it forms when austenite (a solution of carbon in iron) is rapidly cooled past a critical temperature of 723° C. (about 1333° F.). A fine non-lamellar structure, bainite commonly consists of ferrite and cementite. It is similar in constitution to pearlite, but with the ferrite forming by a displacive mechanism similar to martensite formation, usually followed by precipitation of carbides from the supersaturated ferrite or austenite. When formed during continuous cooling, the cooling rate to form bainite is higher than that required to form pearlite, but lower than that to form martensite, in steel of the same composition. Bainite is generally stronger but less ductile than pearlite.)

In some embodiments, MLCA assembly 101 is formed as a single piece and then attached to the underside of vehicle 99 (e.g., bolting, affixing using a bonding material (e.g., an adhesive), or any other suitable attaching means). In some embodiments, assembly 101 has an overall thickness of approximately 50.8 mm to 127 mm (2 inches to 5 inches). In some embodiments, MLCA assembly 101 includes a plurality of individual armor components that are combined and individually affixed to the underside of vehicle 99 to form assembly 101. In some embodiments, the plurality of armor components are placed tightly next to each other on the underside of vehicle 99, but are not interconnected with each other (e.g., in some embodiments, MLCA component 101 has a cross-section shape such as shown in FIG. 4G, wherein component 101 serves as the floorboard of the passenger compartment of vehicle 99.). In other embodiments, the plurality of armor components making up assembly 101 are interconnected with each other and affixed to the underside of vehicle 99 to form assembly 101 (e.g., in some embodiments, MLCA component 101 has a cross-section shape such as shown in FIG. 4F, and therefore only the side components are affixed to vehicle 99 (using, for example, bolts, bonding material, or any other suitable means), while all of the individual components are affixed to each other to provide the overall assembly 101).

Figure 2:
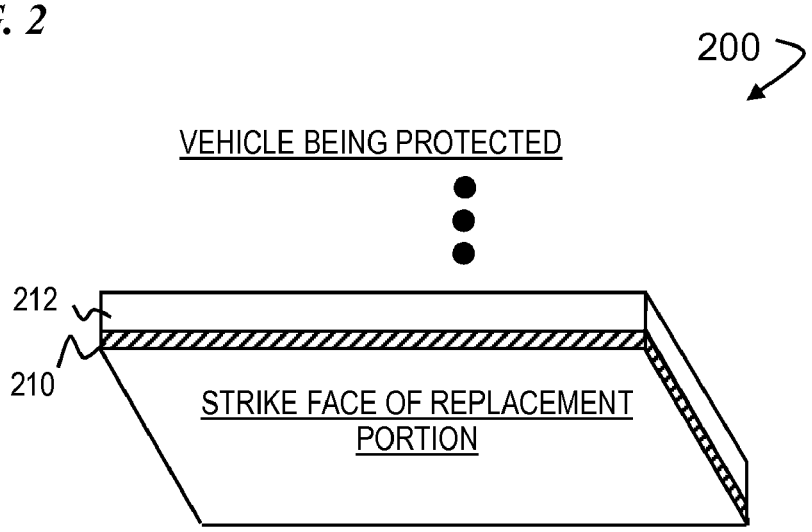
FIG. 2 is a perspective cross-sectional view of a replacement inner-core section 200 that is usable for some embodiments to replace layers 120, 150, and/or 160 of FIG. 1B if they are damaged, according to an example embodiment.

FIG. 2 is a perspective cross-sectional view of a replacement armor section 200 that is usable for some embodiments to replace layers 120, 150, and/or 160 if they are damaged, according to an example embodiment. In some embodiments, as illustrated in FIG. 2, replacement section 200 includes a metal layer 210 (e.g., bainite steel) and fiber-reinforced polymer layer 212 (e.g., deadened non-rebounding polyurethane (e.g., viscoelastic polyurethane such as provided by U.S. Pat. No. 7,238,730, titled "VISCOELASTIC POLYURETHANE FOAM", issued Jul. 3, 2007) reinforced with one or more materials such as basalt fibers, glass fibers, steel fibers, aramid (e.g., Kevlar®) fibers, and ceramic chips). In some embodiments, replacement section 200 has a thickness of approximately 25 to 75 mm. In some embodiments, assembly 101 (as shown in FIG. 1A, FIG. 4E, FIG. 4F or FIG. 4G) is built from replaceable sub-layers such as section 200, and assembly 101 can be repaired in a combat theater by replacing fewer than all of the sub-layers. For example, a side of a humvee could be protected by several overlapping and side-by-side sub-layers that could be individually replaced as needed.

In some embodiments, for example, layer 120 could be made of a plurality of side-by-side sections 200 (see FIG. 2 below) that form layer 120 of FIG. 1B, and those are laid offset to the joints of a plurality of side-by-side sections 200 used to form the next inner layer 150 of FIG. 1B, and those in turn are laid offset to the joints of a plurality of side-by-side sections 200 of the next layer and so on.

Figure 3:
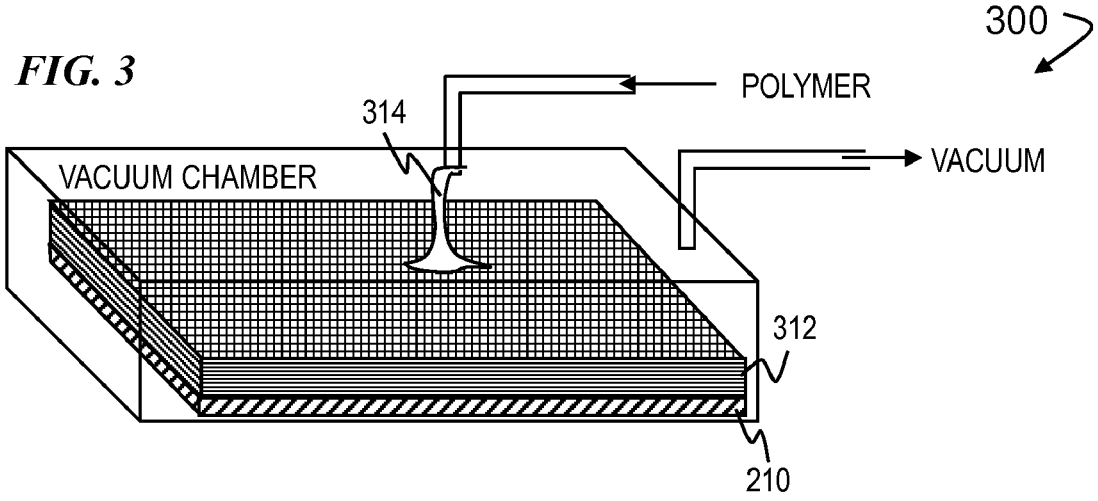
FIG. 3 is a perspective cross-sectional view of an apparatus 300 and method for fabricating void-free sections 200, according to an example embodiment.

FIG. 3 is a perspective cross-sectional view of an apparatus 300 and method for fabricating void-free sections 200, according to an example embodiment. In some embodiments, a plurality of layers or a mass of fibers 312 (e.g., aramid, glass, steel or other suitable fibers) as placed on a metal plate 210 (e.g., layer 122) within a vacuum chamber that is then evacuated, and then a liquid polymer 314 (e.g., a 93A-durometer polyurethane) is injected through a top port to flow between and among the fibers without air bubbles. In some embodiments, once the liquid polymer is in place, air is let back into the chamber to help press the liquid polymer through the fibers and against the metal plate to get a dense strong panel 200, which is then removed from fabrication apparatus 300. The resulting section 200 (used, e.g., as layer 120 or 150 or 160 in the armor 101 of FIG. 1B) can then be joined (by bolting, by adhesive, by Velcro™ or other suitable means, to a plurality of other layers to form or repair an armor assembly 101.

Figure 4A:
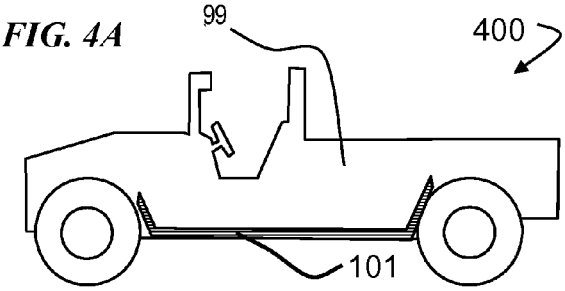
FIG. 4A is a side view of a multi-layer composite belly-plate system 400, according to an example embodiment.
Figure 4B:
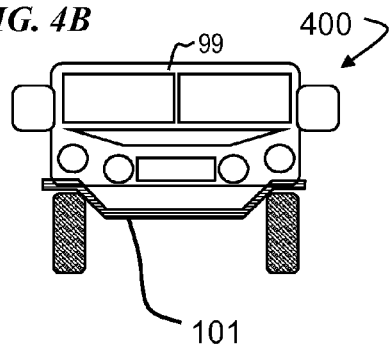
FIG. 4B is a front view of a multi-layer composite belly-plate system 400, according to an example embodiment.
Figure 4C:
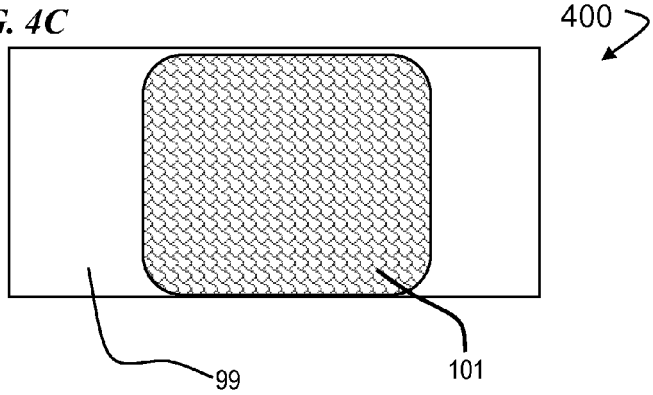
FIG. 4C is a bottom plan view of a multi-layer composite belly-plate system 400, according to an example embodiment.
Figure 4D:
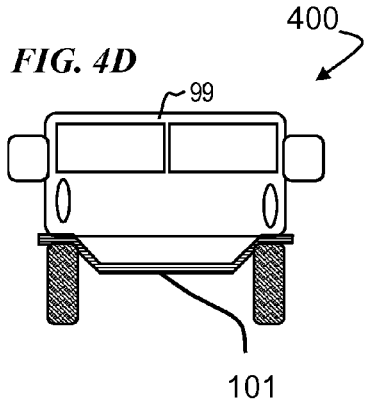
FIG. 4D is a rear view of a multi-layer composite belly-plate system 400, according to an example embodiment.

FIG. 4A is a side view of a multi-layer composite belly-plate system 400, according to an example embodiment. In some such embodiments (not shown), the armor 101 extends to the front of the vehicle (to the far left in the figure) in order to also protect the motor compartment of vehicle 99. FIG. 4B is a front view of multi-layer composite belly-plate system 400, according to an example embodiment. FIG. 4C is a view from the bottom of multi-layer composite belly-plate system 400, according to an example embodiment. Again, in some such embodiments, the armor 101 extends to the front of the vehicle (to the far left in the figure) in order to also protect the motor compartment of vehicle 99. FIG. 4D is a rear view of multi-layer composite belly-plate system 400, according to an example embodiment. In some embodiments, MLCA assembly 101 includes one or more of the designs of FIG. 1B, 4E, 4F, 4G, 9A, or 9B as at least part of their armor. In some embodiments, one or more pieces of assembly 101 are applied to the sides, front, back, or top of vehicle 400.

Figure 4E:
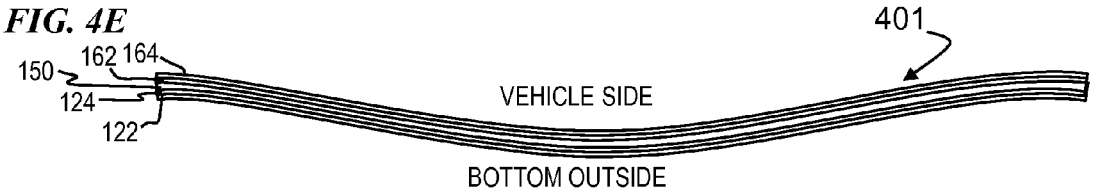
FIG. 4E is a side-to-side cross section view of a multi-layered composite armor assembly 401, according to an example embodiment.
Figure 4F:
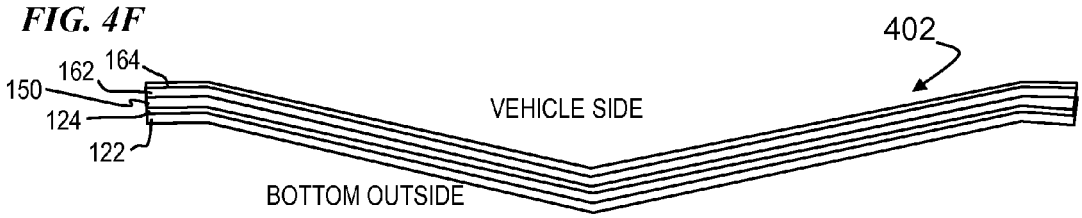
FIG. 4F is a side-to-side cross section view of a multi-layered composite armor assembly 402, according to an example embodiment.
Figure 4G:
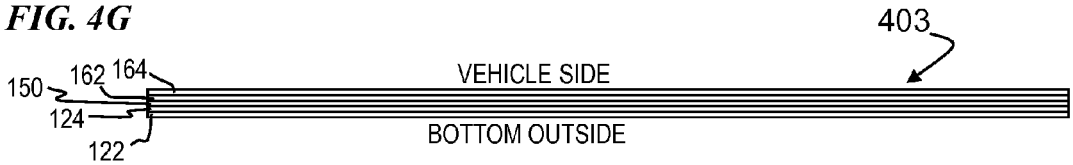
FIG. 4G is a side-to-side cross section view of a multi-layered composite armor assembly 403, according to an example embodiment.

FIG. 4E is a side-to-side cross section view of a multi-layered composite armor assembly 401, according to an example embodiment. In some embodiments, multi-layered composite armor assembly 401 is a shaped plate made with layers as described for FIG. 1B, FIG. 9A, or FIG. 9B, but shaped to have a convex downward-facing center surface and concave downward-facing sides (a cross-section shape similar to an old-style curved archery bow). This curved shape strengthens the plate as well as helps to deflect some of the blast to the sides.

FIG. 4F is a side-to-side cross section view of a multi-layered composite armor assembly 402, according to an example embodiment. In some embodiments, multi-layered composite armor assembly 402 is a shaped plate made with layers as described for FIG. 1B, FIG. 9A, or FIG. 9B, but shaped to have an angled-faces downward-facing center surface and concave angled downward-facing sides (a chevron shape with horizontal wings for the running boards). In some embodiments, this angled shape is easier to fabricate than that of FIG. 4E, but still strengthens the plate as well as helps to deflect some of the blast to the sides.

In some embodiments, the embodiments of FIG. 4E or FIG. 4F include a sloped front air scoop (e.g., sloped downward in the front, in some embodiments) to help direct cooling air to the exhaust system of the vehicle. In other embodiments, an air scoop placed elsewhere directs the cooling air to between the armor assembly (e.g., armor assembly 401, 402, or 403) and vehicle 99. In still other embodiments, other suitable ventilation systems are provided such that the underbelly armor assembly (e.g., armor assembly 401, 402, or 403) does not cause vehicle 99 to overheat during operation.

FIG. 4G is a side-to-side cross section view of a multi-layered composite armor assembly 403, according to an example embodiment. In some embodiments, multi-layered composite armor assembly 403 is a flat plate made with layers as described for FIG. 1B, FIG. 9A, or FIG. 9B. This shape is easier to fabricate than that of FIG. 4E or FIG. 4F, and still provides substantial protection. In some embodiments, armor assembly 403 forms the floorboard of the passenger compartment of vehicle 99.

Figure 5A:
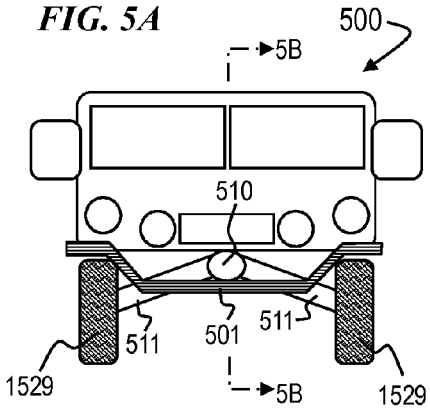
FIG. 5A is a front view of a multi-layer composite belly-plate system 500, according to an example embodiment.
Figure 5B:
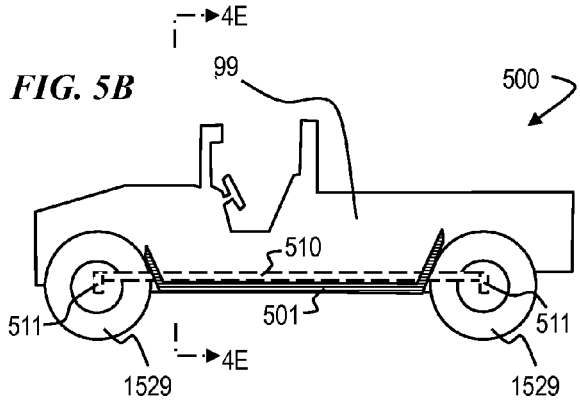
FIG. 5B is a side view of a multi-layer composite belly-plate system 500, according to an example embodiment.

FIG. 5A is a front view of a multi-layer composite belly-plate system 500, according to an example embodiment. FIG. 5B is a side view (partially in cross section) of multi-layer composite belly-plate system 500, according to an example embodiment. In this embodiment, the overall shape is similar to an upside-down turtle shell, convex rounded at its lowest portion. In some embodiments, the side-to-side cross section is similar to that shown in FIG. 4E.

Figure 6A:
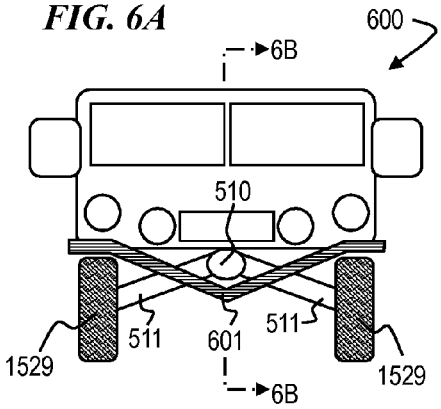
FIG. 6A is a front view of a multi-layer composite belly-plate system 600, according to an example embodiment.
Figure 6B:
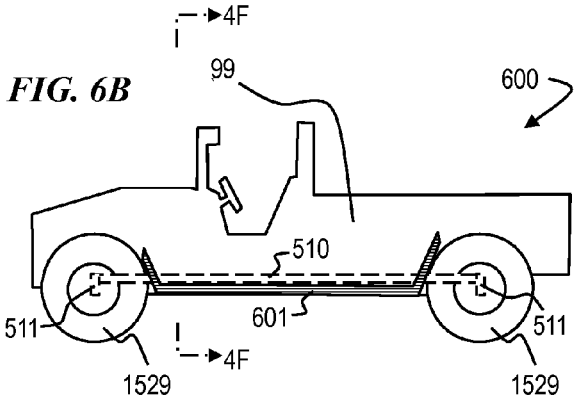
FIG. 6B is a side view of a multi-layer composite belly-plate system 600, according to an example embodiment.

FIG. 6A is a front view of a multi-layer composite belly-plate system 600, according to an example embodiment. FIG. 6B is a side view (partially in cross section) of multi-layer composite belly-plate system 600, according to an example embodiment. In this embodiment, the overall shape is "V" shaped, convex pointed at its lowest portion. In some embodiments, the side-to-side cross section is similar to that shown in FIG. 4F.

Figure 7A:
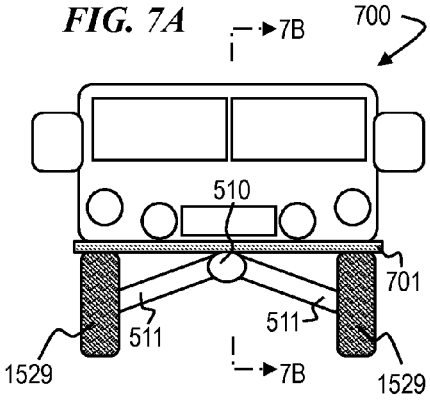
FIG. 7A is a front view of a multi-layer composite belly-plate system 700, according to an example embodiment.
Figure 7B:
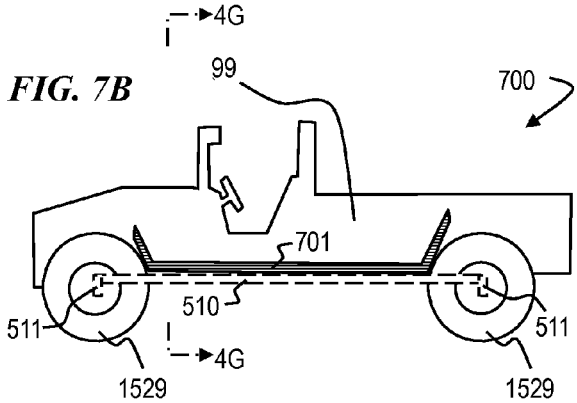
FIG. 7B is a side view of a multi-layer composite belly-plate system 700, according to an example embodiment.

FIG. 7A is a front view of a multi-layer composite belly-plate system 700, according to an example embodiment. FIG. 7B is a side view (partially in cross section) of multi-layer composite belly-plate system 700, according to an example embodiment. In this embodiment, the overall shape is substantially flat at its lowest portion. In some embodiments, the side-to-side cross section is similar to that shown in FIG. 4G.

In some embodiments, as illustrated in FIGS. 5A and 5B (and in FIGS. 6A and 6B), drift shaft 510 of vehicle 99 is located in between the bottom surface of vehicle 99 and the multi-layered composite armor assembly (e.g., assembly 501, assembly 601, or assembly 701). In some embodiments, wheel axles 511 connect wheels 1529 to drive shaft 510 by passing through the multi-layered composite armor assembly. In other embodiments (as illustrated in FIGS. 7A and 7B), drive shaft 510 is located outside of the armor assembly such that the armor assembly touches or is part of the bottom surface of vehicle 99.

FIGS. 8A through 8E illustrate an apparatus and method for fabricating a multi-layer composite armor assembly, according to an example embodiment. In some embodiments, the method and apparatus includes a plurality of material sources 820, each having a respective valve 821 that controls the flow of the material through spray nozzle 810 and onto substrate 805. In some embodiments, substrate 805 includes a metal layer (e.g., bainite-hardened steel), and the material sources 820 include four polyurethanes that each have a different durometer value (e.g., in some embodiments, material L is a 93A-durometer polyurethane, material E is a 90A-durometer polyurethane, material A is a 86A-durometer polyurethane, and material C is a 83A-durometer polyurethane). In some embodiments, each layer of material is sprayed onto substrate 805 such that a multi-layer composite armor assembly is formed (e.g., assembly 101 shown in FIG. 1 or assembly 901 shown in FIG. 9). In some embodiments, each layer of material is sprayed onto substrate 805 such that the plurality of materials 820 add to substrate 805 in a conspicuously-stratified manner (i.e., each individual material layer can be easily identified within the armor assembly). In some embodiments, each layer of material is sprayed onto substrate 805 such that the plurality of materials 820 add to substrate 805 in a blended, continuous manner (i.e. individual material layers within the armor assembly cannot be easily identified). In some embodiments, the plurality of materials include a plurality of polymers, and the fabrication apparatus and method include, or are substantially similar to, the system described in U.S. Pat. No. 6,465,047, issued Oct. 15, 2002, and titled "PRECISION POLYMER DISPERSION APPLICATION BY AIRLESS SPRAY" which is incorporated herein by reference.

Figure 8A:
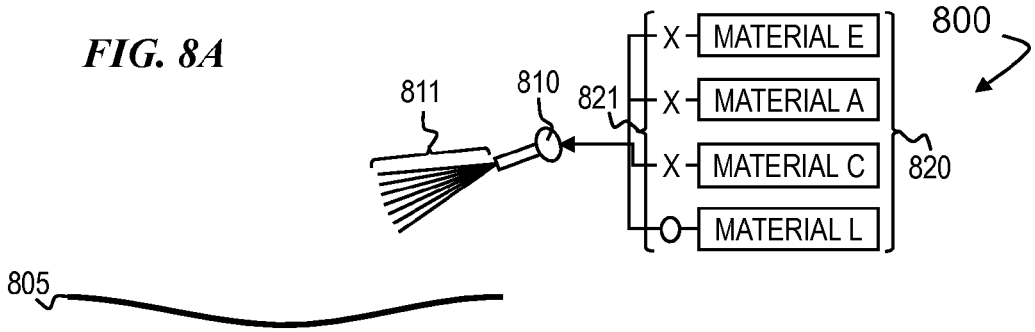
FIG. 8A is a schematic view of the fabrication process and apparatus at initial fabrication stage 800.
Figure 8B:
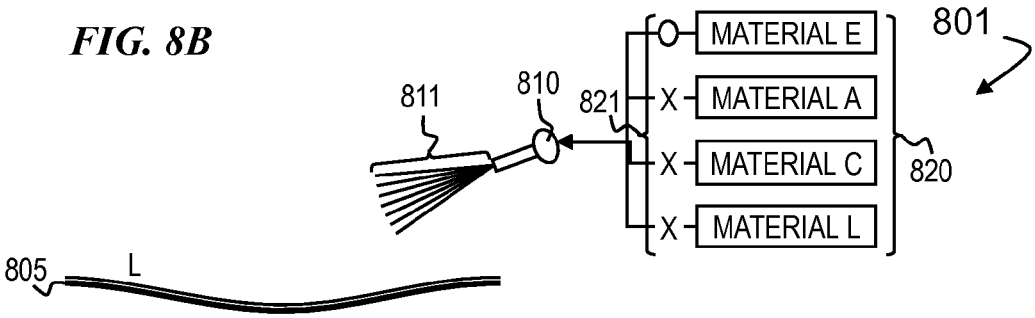
FIG. 8B is a schematic view of the fabrication process and apparatus at fabrication stage 801.
Figure 8C:
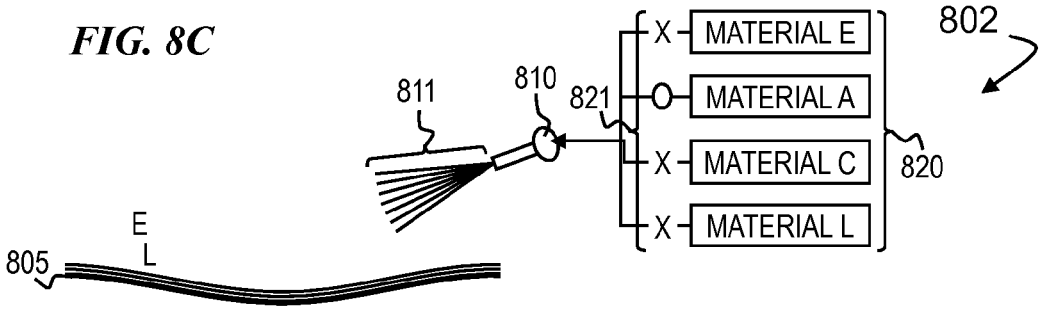
FIG. 8C is a schematic view of the fabrication process and apparatus at fabrication stage 802.
Figure 8D:
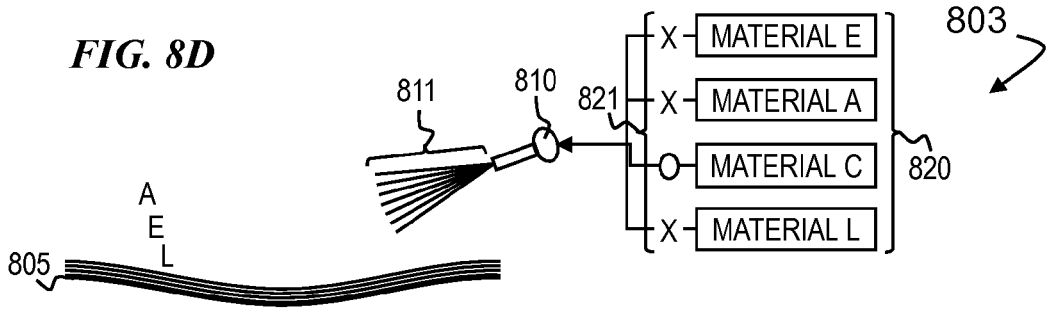
FIG. 8D is a schematic view of the fabrication process and apparatus at fabrication stage 803.
Figure 8E:
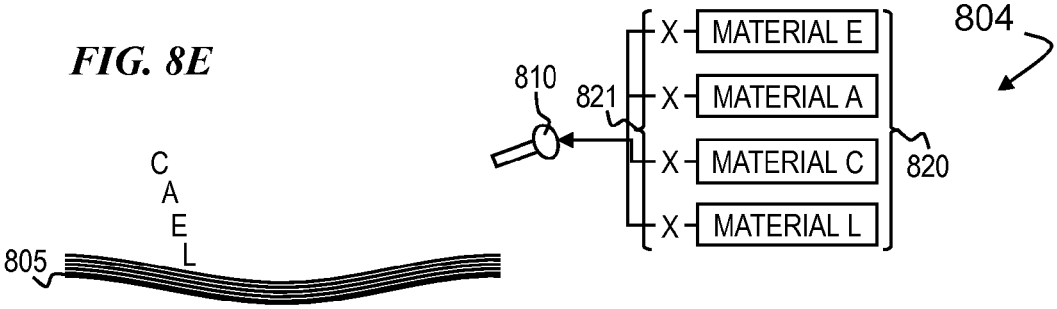
FIG. 8E is a schematic view of the fabrication process and apparatus at fabrication stage 804.

FIG. 8A is a schematic view of the fabrication process and apparatus at initial fabrication stage 800 where material L's valve is open (and the valves of the other materials are closed) such that material L is sent through spray nozzle 810 to form a spray or mist 811 that causes material L to build up on substrate 805. FIG. 8B is a schematic view of the fabrication process and apparatus at fabrication stage 801 where material E's valve is open (and the valves of the other materials are closed) such that material E is sent through spray nozzle 810 to form a spray or mist 811 that causes material E to build up on the previously-formed substrate 805/material L combination. FIG. 8C is a schematic view of the fabrication process and apparatus at fabrication stage 802 where material A's valve is open (and the valves of the other materials are closed) such that material A is sent through spray nozzle 810 to form a spray or mist 811 that causes material A to build up on the previously-formed substrate 805/material L/material E combination. FIG. 8D is a schematic view of the fabrication process and apparatus at fabrication stage 803 where material C's valve is open (and the valves of the other materials are closed) such that material C is sent through spray nozzle 810 to form a spray or mist 811 that causes material C to build up on the previously-formed substrate 805/material L/material E/material A combination. FIG. 8E is a schematic view of the fabrication process and apparatus at fabrication stage 804 where all of the valves 821 are closed such that no material is sent through spray nozzle. In some embodiments, the completed multi-layer composite armor assembly at stage 804 includes substrate 805 and successive layers of material L, material E, material A, and material C (wherein the identifying letters are arbitrarily chosen).

Figure 9A:
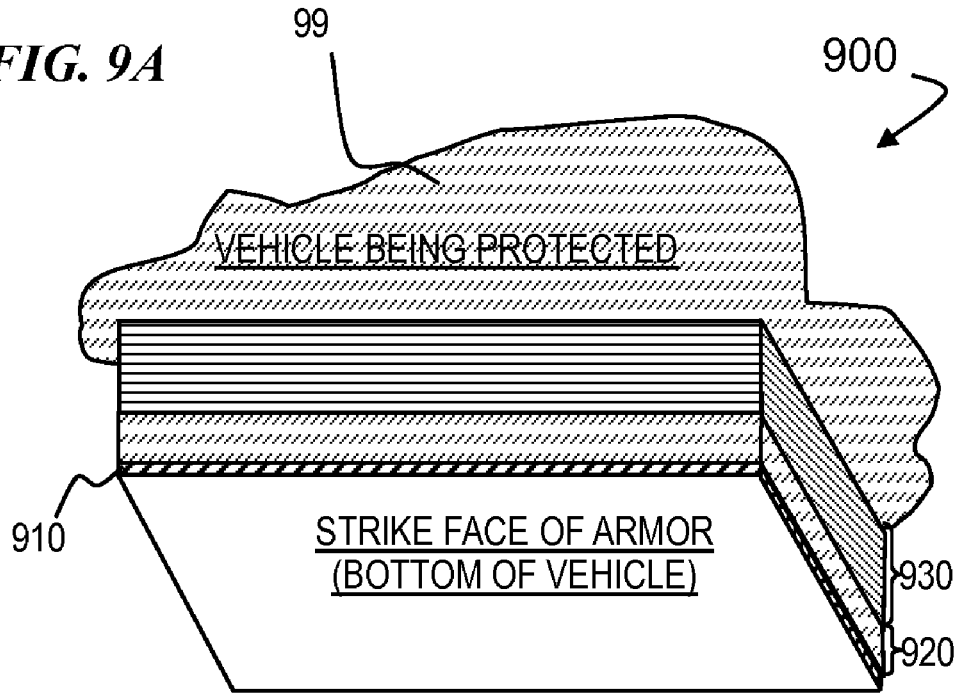
FIG. 9A is a perspective cross-section view of a multi-layered composite armor assembly 900, according to an example embodiment.

FIG. 9A is a perspective cross-section view of a multi-layered composite armor assembly 900, according to an example embodiment. In some embodiments, assembly 900 includes a metal layer 910, a first polymer layer 920, and a second polymer layer 930. In some embodiments, metal layer 910 includes bainite steel and serves as the strike-face layer of assembly 900. In some embodiments, polymer layer 920 includes a polyurethane (e.g., in some embodiments, fiber reinforced with fibers such as basalt fibers, glass fibers, steel fibers, or aramid (e.g., Kevlar®) fibers) having a first durometer value and polymer layer 930 includes a polyurethane (in some embodiments, also fiber reinforced with fibers such as basalt fibers, glass fibers, steel fibers, or aramid (e.g., Kevlar®) fibers) having a second durometer value, wherein the first durometer value is higher than the second durometer value. In some embodiments, assembly 900 is fabricated using the method and apparatus shown in FIGS. 8A through 8E. In some embodiments, as illustrated in FIG. 9A, assembly 900 is conspicuously-stratified such that there is a clear division between polymer layer 920 and polymer layer 930.

Figure 9B:
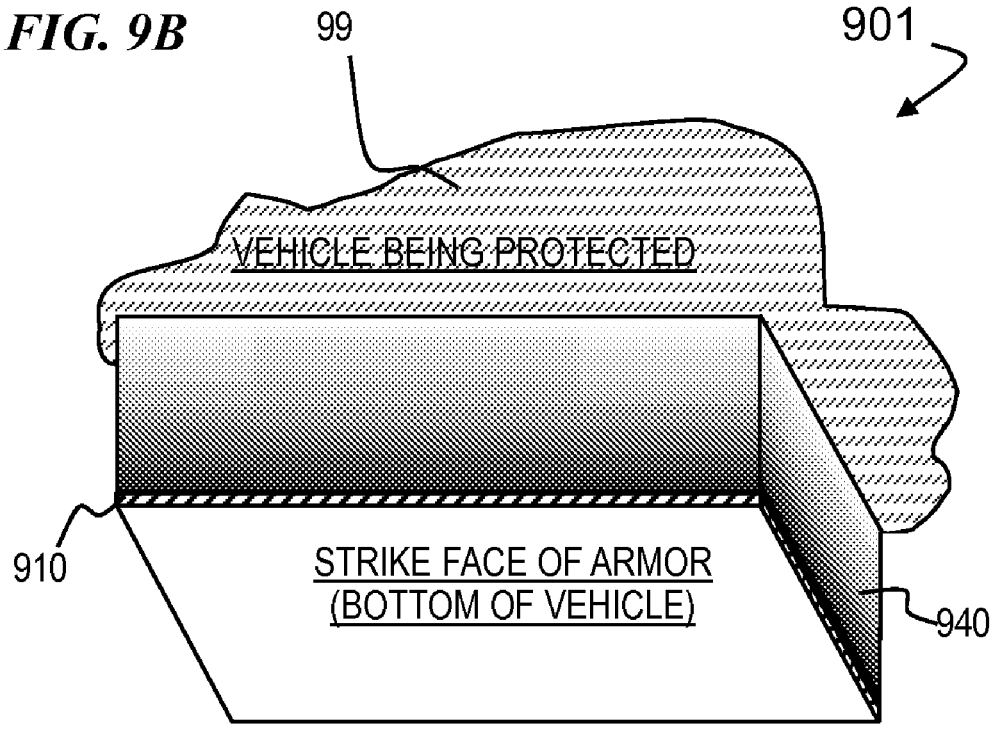
FIG. 9B is a perspective cross-section view of a multi-layered composite armor assembly 901, according to an example embodiment.

FIG. 9B is a perspective cross-section view of a multi-layered composite armor assembly 901, according to an example embodiment. In some embodiments, assembly 901 is fabricated using the method and apparatus shown in FIGS. 8A through 8E. In some embodiments, assembly 901 includes a metal layer 910 and a polymer layer 940. In some embodiments, polymer layer 940 includes a plurality of individual polyurethane layers each having a different durometer value, wherein the individual polyurethane layers are blended together in a continuous gradient (i.e., the individual polyurethane layers are not easily visible or necessarily detectable) such that polymer 940 has a first hard durometer value near metal layer 910 and then the durometer value of polymer 940 continuously decreases through polymer 940 toward vehicle 99 until reaching the soft durometer value of polymer 940 at the location closest to vehicle 99. For example, in some embodiments, the durometer value of polymer layer 940 decreases from a value of 93A near metal layer 910 to a value of 83A near vehicle 99.

In some embodiments, the present invention provides a method for making a multi-layer composite-armor article that includes providing a first metal layer, the metal layer having an outer face that will be closer to an outermost surface of the armor article, and an inner face that will be farther from the outermost surface of the armor article; and attaching a multi-layer polymer structure to the inner face of the first metal layer, the polymer structure having an inner portion that is farther from the inner face of the metal layer than an outer portion of the polymer structure that is attached to the inner face of the first metal layer, wherein the inner portion has a lower durometer value than the outer portion. In some embodiments, the method further includes adding fiber reinforcement in at least one layer of the armor article.

In some embodiments, the first metal layer is an outermost layer of the multi-layer composite-armor article. In some embodiments, the first metal layer includes bainite steel.

In some embodiments, the method further includes forming at least a first layer and a second layer of the armor article as separate structures; and bonding the first layer to the second layer with an adhesive material.

In some embodiments, the method further includes providing a vehicle; and affixing the armor article to an underside of the vehicle such that the inner portion is pressed against a floor structure of a passenger compartment of the vehicle.

In some embodiments, the method further includes forming the polymer structure such that at least a portion of the polymer structure has a durometer value that varies continuously from a higher durometer value nearer the first metal layer to a lower durometer value nearer the passenger compartment.

In some embodiments, the polymer structure includes polyurethane. In some embodiments, the method includes providing a vehicle; affixing the armor article to an underside of the vehicle such that the inner portion is pressed against a floor structure of a passenger compartment of the vehicle; providing a second metal layer between the inner portion of the polymer structure and the outer portion of the polymer structure; shaping the metal layer to have a downward-pointing v-shaped portion; incorporating a basalt-fiber layer in the polymer structure; and forming a plurality of intermingled recessed and elevated areas on an inner face of the inner portion of the polymer structure such that less than about 75% of the inner face is contacting the vehicle; forming a polymer layer on the outer face of the first metal layer. In other embodiments, less than about 90% of the inner face is contacting the vehicle. In other embodiments, less than about 80% of the inner face is contacting the vehicle. In other embodiments, less than about 70% of the inner face is contacting the vehicle. In other embodiments, less than about 60% of the inner face is contacting the vehicle. In other embodiments, less than about 50% of the inner face is contacting the vehicle.

In some embodiments, the first metal layer and the second metal layers include a steel alloy. In some embodiments, the polymer structure includes at least two layers each made of a different type of polyurethane, wherein the at least two layers include a first layer of 93A-durometer ester polyurethane and a second layer of 83A-durometer ester polyurethane. In some embodiments, the armor article is composed of a plurality of separable pieces that can be interchangeably assembled to the vehicle. In other embodiments, the outermost polymer layer that is inward from the outer steel layer (i.e., the first layer) has a durometer value of about Shore 95A (about Shore 46D). In some embodiments, the outermost polymer layer has a durometer value of about Shore 90A (about Shore 46D). In some embodiments, the outermost polymer layer has a durometer value of about Shore 85A (about Shore 33D). In some embodiments, the outermost polymer layer has a durometer value of more than Shore 95A (more than about Shore 46D). In some embodiments, the outermost polymer layer has a durometer value of about Shore 100A (about Shore 58D). In some embodiments, the outermost polymer layer has a durometer value more than Shore 58D.

In some embodiments, the innermost polymer layer has a durometer value of about Shore 85A (about Shore 33D). In some embodiments, the innermost polymer layer has a durometer value of about Shore 80A (about Shore 29D). In some embodiments, the innermost polymer layer has a durometer value of about Shore 75A (about Shore 25D). In some embodiments, the innermost polymer layer has a durometer value of about Shore 70A (about Shore 22D). In some embodiments, the innermost polymer layer has a durometer value of about Shore 65A (about Shore 19D). In some embodiments, the innermost polymer layer has a durometer value of less than about Shore 65A (less than about Shore 19D).

In some embodiments, the polymer structure includes high-tensile-strength polyurethane such as obtained using Andur 5 DPLM-brand prepolymer (Andur 5-DPLM is a polyester based, toluene diisocyanate terminated prepolymer. An elastomer with a hardness of 50 Shore D is obtained when this prepolymer is cured with Curene 442 [4,4'-methylene-bis (orthochloroaniline)]. Elastomers of lower hardness can be obtained by curing Andur 5-DPLM with polyols and their combination with Curene 442 and other diamines, or through the use of plasticizers), wherein 5 DPLM and Curene 442 are available through Anderson Development Corporation (www.andersondevelopment.com/surv_bin.php?x={8 DB8A7-00940126-EE592E}&y=1).

In some embodiments, the present invention provides a multi-layer composite-armor article that includes a first metal layer, wherein the metal layer has an outer face that will be closer to an outermost surface of the armor article, and an inner face that will be farther from the outermost surface of the armor article; and a multi-layer polymer structure attached to the inner face of the first metal layer, wherein the polymer structure has an inner portion that is farther from the inner face of the metal layer than an outer portion of the polymer structure that is attached to the inner face of the first metal layer, and the inner portion has a lower durometer value than the outer portion. In some embodiments, the apparatus further includes fiber reinforcement located in at least one layer of the armor article.

In some embodiments, the first metal layer is an outermost layer of the multi-layer composite-armor article. In some embodiments, the first metal layer includes bainite steel.

In some embodiments, at least a first layer and a second layer of the armor article are formed as separate structures, and the first layer is bonded to the second layer with an adhesive material.

In some embodiments, the apparatus further includes a vehicle, wherein the armor article is affixed to an underside of the vehicle such that the inner portion is pressed against a floor structure of a passenger compartment of the vehicle.

In some embodiments, at least a portion of the polymer structure has a durometer value that varies continuously from a higher durometer value nearer the first metal layer to a lower durometer value nearer the passenger compartment.

In some embodiments, the polymer structure includes polyurethane, wherein the metal layer has a downward-pointing v-shaped portion. In some embodiments, the polymer structure includes a basalt-fiber layer. In some embodiments, the apparatus further includes a vehicle, wherein the armor article is affixed to an underside of the vehicle such that the inner portion is pressed against a floor structure of a passenger compartment of the vehicle; a second metal layer located between the inner portion of the polymer structure and the outer portion of the polymer structure; and a polymer layer located on the outer face of the first metal layer. In some embodiments, the polymer structure includes a plurality of intermingled recessed and elevated areas on an inner face of the inner portion of the polymer structure such that less than about 75% of the inner face is contacting the vehicle. In some embodiments, the polymer structure includes at least two layers each made of a different type of polyurethane. In some embodiments, the first metal layer and the second metal layers include a steel alloy. In some embodiments, the armor article is composed of a plurality of separable pieces that can be interchangeably assembled to the vehicle.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A method for making a multi-layer composite-armor article that is configured to protect a land vehicle, the method comprising:

providing the land vehicle having an underside;

providing a first metal layer, the metal layer having an outer face that will be closer to an outermost surface of the armor article, and an inner face that will be farther from the outermost surface of the armor article;

attaching a multi-layer polymer structure to the inner face of the first metal layer, the polymer structure having a plurality of solid polymer layers including an outer polymer layer and an inner polymer layer, wherein the inner polymer layer is farther from the inner face of the metal layer than the outer polymer layer of the polymer structure, wherein the outer polymer layer is attached to the inner face of the first metal layer, and wherein the inner polymer layer has a lower durometer value than the outer polymer layer;

shaping the armor article such that the first metal layer has a convex downward-facing center surface, and configuring the armor article to attach to the underside of the land vehicle; and affixing the armor article to the underside of the land vehicle.

2. The method of claim 1, wherein the first metal layer is an outermost layer of the multi-layer composite-armor article.

3. The method of claim 1, wherein the first metal layer includes bainite steel.

4. The method of claim 1, further comprising forming at least the first polymer layer and the second polymer layer of the armor article as separate structures;

bonding the first polymer layer to the second polymer layer with a bonding material; and adding fiber reinforcement in at least one polymer layer of the armor article.

5. The method of claim 1, wherein the affixing of the armor article to the underside of the land vehicle includes affixing the armor article such that the inner polymer layer is pressed against a floor structure of a passenger compartment of the land vehicle.

6. The method of claim 5, further comprising forming the polymer structure such that at least a portion of the polymer structure has a durometer value that varies continuously from a higher durometer value nearer the first metal layer to a lower durometer value nearer the passenger compartment.

7. The method of claim 1, wherein the polymer structure includes polyurethane; the method further comprising:

inserting a second metal layer between the inner layer of the polymer structure and the outer layer of the polymer structure.

8. A multi-layer composite-armor apparatus comprising:

an armor article configured to be affixed to an underside of a land vehicle, the armor article including:

a first metal layer, wherein the metal layer has an outer face that will be closer to an outermost surface of the armor article, and an inner face that will be farther from the outermost surface of the armor article, wherein the first metal layer has a convex downward-facing center surface; and a multi-layer polymer structure attached to the inner face of the first metal layer, wherein the polymer structure has a plurality of solid polymer layers including an outer polymer layer and an inner polymer layer, wherein the inner polymer layer is farther from the inner face of the metal layer than the outer polymer layer of the polymer structure, wherein the outer polymer layer is attached to the inner face of the first metal layer, and wherein the inner polymer layer has a lower durometer value than the outer polymer layer.

9. The apparatus of claim 8, wherein the first metal layer is an outermost layer of the multi-layer composite-armor article.

10. The apparatus of claim 8, wherein the first metal layer includes bainite steel.

11. The apparatus of claim 8, wherein at least the first polymer layer and the second polymer layer of the armor article are formed as separate structures, and wherein the first polymer layer is bonded to the second polymer layer with an adhesive material.

12. The apparatus of claim 8, further comprising the land vehicle, wherein the armor article is affixed to the underside of the land vehicle such that the inner polymer layer of the polymer structure is pressed against a floor structure of a passenger compartment of the land vehicle.

13. The apparatus of claim 12, wherein at least a portion of the polymer structure has a durometer value that varies continuously from a higher durometer value nearer the first metal layer to a lower durometer value nearer the passenger compartment.

14. The apparatus of claim 8, wherein the polymer structure includes polyurethane, wherein the polymer structure includes a basalt-fiber layer, the apparatus further comprising:

the land vehicle, wherein the armor article is affixed to an underside of the land vehicle such that the inner polymer layer is pressed against a floor structure of a passenger compartment of the vehicle; and a second metal layer located between the inner polymer layer of the polymer structure and the outer polymer layer of the polymer structure.

15. The article of claim 8, wherein the land vehicle has a plurality of wheels including a first wheel on a front-left side of the land vehicle and a second wheel on a back-right side of the land vehicle, opposite the front-left side, and wherein the article is affixed to the underside of the land vehicle in a location that is between the first wheel and the second wheel.

16. The article of claim 8, wherein the armor article further includes a first concave downward-facing side surface located on a left-hand side of the convex downward-facing center surface and a second concave downward-facing side surface located on a right-hand side of the convex downward-facing center surface, opposite the left-hand side.

17. A multi-layer composite-armor article configured to be affixed to an underside of a land vehicle, the composite-armor article comprising:

means for deflecting blast force having an outer face having a convex center surface that will be closer to an outermost surface of the armor article, and an inner face that will be farther from the outermost surface of the armor article; and multi-layer polymer means for cushioning an impact, the polymer means for cushioning affixed to the inner face of the means for deflecting blast force, wherein the polymer means for cushioning has a plurality of solid polymer layers including an inner polymer layer and an outer polymer layer, wherein the inner polymer layer is farther from the inner face of the means for deflecting blast force than the outer polymer layer of the polymer means for cushioning, wherein the outer polymer layer is attached to the inner face of the means for deflecting blast force, and wherein the inner polymer layer has a lower durometer value than the outer polymer layer.

18. The article of claim 17, wherein the means for deflecting blast force includes a first metal layer that forms an outermost strike-face of the multi-layer composite armor.

19. The article of claim 17, wherein the means for deflecting blast force includes a first metal layer that includes bainite steel.

20. The article of claim 17, wherein at least the first polymer layer and the second polymer layer of the polymer means for cushioning are formed as separate structures and the polymer means for cushioning includes an adhesive material that bonds the first polymer layer to the second polymer layer, the article further comprising means for fiber reinforcing within the polymer means for cushioning.

21. The article of claim 17, further comprising the land vehicle, wherein the armor article is affixed to the underside of the land vehicle such that the inner polymer layer of the polymer means for cushioning is pressed against a floor structure of a passenger compartment of the land vehicle.

22. The article of claim 17, wherein the polymer means for cushioning includes polyurethane, the land vehicle, wherein the composite-armor article is affixed to the underside of the land vehicle such that the inner polymer layer of the polymer means for cushioning is pressed against a floor structure of a passenger compartment of the land vehicle; and wherein the armor article includes a metal layer bonded between the inner polymer layer of the polymer means for cushioning and the outer polymer layer of the polymer means for cushioning.

* * * * *